United States Patent [19]

Tikes et al.

[11] Patent Number: 5,072,202

[45] Date of Patent: Dec. 10, 1991

[54] WIDEBAND POWER MICROWAVE WINDOW WITH IMPROVED MECHANICAL AND ELECTRICAL BEHAVIOR

[75] Inventors: Jacques Tikes, Orsay; Alain Durand, Velizy Villacoublay, both of France

[73] Assignee: Thomson Tubes Electroniques, Boulogne, France

[21] Appl. No.: 593,977

[22] Filed: Oct. 9, 1990

[30] Foreign Application Priority Data

Oct. 17, 1989 [FR] France ..... 89 13535

[51] Int. Cl.[5] ..... H01P 1/08

[52] U.S. Cl. ..... 333/252; 333/33

[58] Field of Search ..... 333/33, 35, 252

[56] References Cited

U.S. PATENT DOCUMENTS

| | | | |
|---|---|---|---|
| 3,387,237 | 6/1968 | Cook . | |
| 3,436,694 | 4/1969 | Walker | 333/252 |
| 3,775,709 | 11/1973 | Firmain et al. . | |
| 4,358,744 | 11/1982 | Tikes | 333/252 X |
| 4,556,854 | 12/1985 | Hiramatsu | 333/34 |

FOREIGN PATENT DOCUMENTS

| | | |
|---|---|---|
| 153541 | 9/1985 | European Pat. Off. . |
| 1765640 | 8/1971 | Fed. Rep. of Germany . |

*Primary Examiner*—Paul Gensler

*Attorney, Agent, or Firm*—Oblon, Spivak, McClelland, Maier & Neustadt

[57] ABSTRACT

Disclosed is a microwave window comprising a circular strip mounted in a circular waveguide section connected, on either side, to a rectangular waveguide containing a matching transformer. The diameter of the circular waveguide is smaller than the diagonal of the rectangle. A wall provides for impervious sealing with respect to the exterior between the rectangular waveguide and the circular waveguide section. Each wall is provided with an aperture included in a portion of cross-section common to the rectangular waveguide and to the circular waveguide section. The area of the aperture is smaller than the area of the portion of cross-section. The disclosed device can be applied to wideband power microwave windows with improved mechanical and electrical behavior.

8 Claims, 2 Drawing Sheets

FIG. 1a PRIOR ART
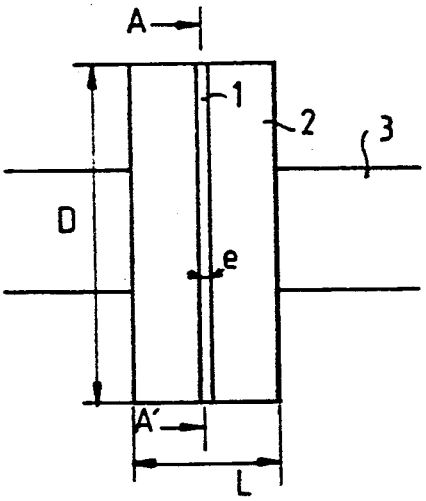
FIG. 1b
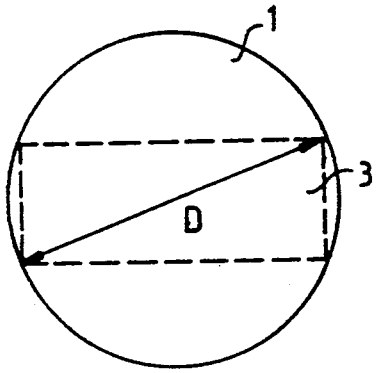
FIG. 2a PRIOR ART
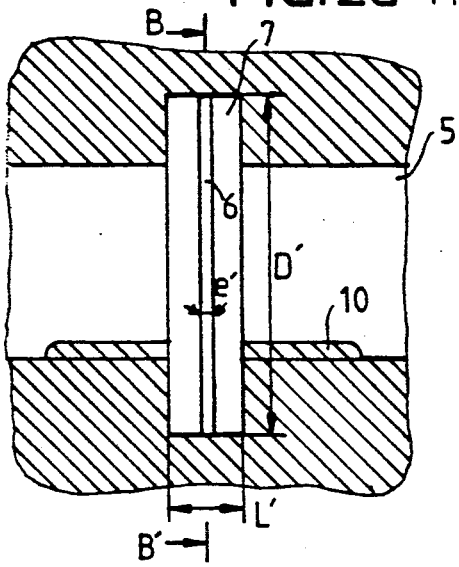
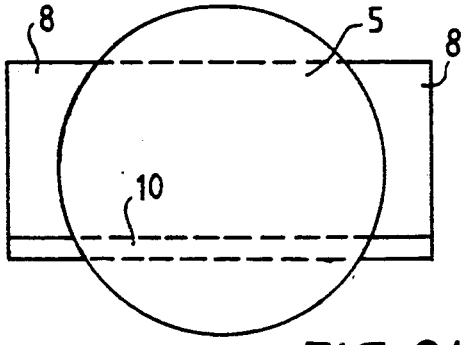
FIG. 2b
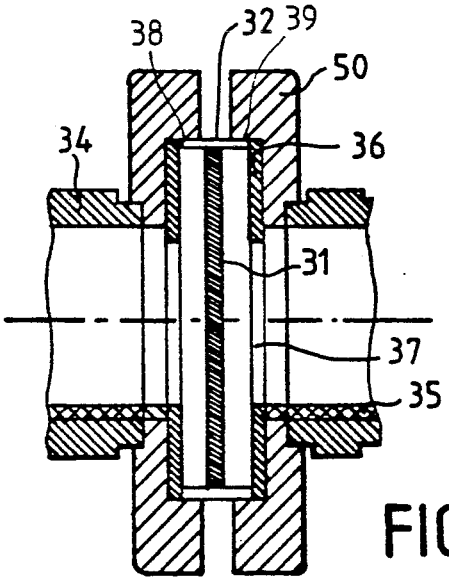
FIG. 4

WIDEBAND POWER MICROWAVE WINDOW WITH IMPROVED MECHANICAL AND ELECTRICAL BEHAVIOR

BACKGROUND OF THE INVENTION

1. Field of the Invention

The present invention concerns a circular microwave window that can work at high power in a wide frequency band.

Microwave devices that work at different atmospheric pressures require the use of microwave windows. The windows are designed to insulate these devices from atmospheric pressure, but they enable the propagation of microwaves without introducing reflection or internal resonance.

Microwave tubes generally work at an extremely low pressure while certain components such as circulators, isolators, coaxial lines and waveguides may contain a gas taken to a pressure that is higher than atmospheric pressure to improve their behavior under power.

Consequently, a microwave window should have solidity sufficient to withstand pressures of the order of several kilograms per square centimeter, without damage.

Moreover, a microwave window should withstand short-lived anomalies such as electric flashes, mechanical stresses such as shocks and vibrations, and temperature variations which may be great, especially if the window is brazed to a frame or into a waveguide. If this is not the case, there is the risk that the window might break, and then air will enter the microwave device and cause it to deteriorate.

Moreover, it is desirable for microwave windows to be capable of being used in a wide frequency band. This frequency band will correspond to the working frequency band of the microwave devices in which they are mounted.

In this frequency band, the windows should not have stray internal resonance modes, also known as ghost modes.

Furthermore, in this frequency band, the standing wave ratio should be low and, consequently, there should be a small degree of reflections.

2. Description of the Prior Art

Among prior art microwave windows there is, notably, the pillbox window. As shown in FIGS. 1*a*, 1*b*, this window is formed by a thin strip 1 of a dielectric material brazed into a circular waveguide section 2. The circular waveguide section 2 is connected on either side to a rectangular waveguide 3.

As is shown more particularly in FIG. 1*b*, the diameter D of the circular guide 2 (which is also that of the dielectric strip 1) is substantially equal to the diagonal of the rectangular guide 3.

These dimensions make it possible to keep substantially the same wavelengths of guided electrical waves in the rectangular guide 3 and the circular guide section 2.

Furthermore, the length L of the circular waveguide section 2 is chosen so as to be substantially equal to half of the guided wavelength $1_g$.

The pill-box type window behaves like a half-wave matching transformer. The result thereof is that the matching is accurate at the working center frequency but gradually deteriorates on either side.

This type of window has many ghost modes, and this fact reduces its effective working bandwidth to about 12% as compared with the center frequency.

Furthermore, owing to its dimensions, the pill-box window is relatively brittle but, technologically, it is easy to make.

There are sturdy microwave windows in existence. These are generally made of thick ceramic. They are mounted in a rectangular waveguide and block the entire cross-section of this guide. They have the shape of a rectangular parallelepiped and their thickness corresponds to a half wavelength of the working center frequency in the rectangular waveguide for a window made of alumina.

These windows have a working band that is extremely restricted because of the thickness of the ceramic. The working bandwidth is about 5% to 7% of the working center frequency in the rectangular waveguide for a window made of alumina.

Another type of window has been described in the French patent No. FR 2 558 306 filed on 17th January 1984. This window is derived from the pill-box window but has a widened working band.

As is shown in FIGS. 2*a*, 2*b*, the window has a thin circular strip 6 made of dielectric material brazed into a circular guide section 7. The diameter D' of the strip is equal to the diameter of the circular guide 7. The ends of this circular guide section 7 are connected to a rectangular guide 5.

The window is equivalent to a resonant volume within which undesirable ghost modes may develop. Within the circular waveguide section 7, and at the frequencies used, it is the $TM_{010}$ and $TE_{111}$ modes that may appear. If these modes are not to be excited, the diameter D' of the strip 6, its thickness e' and the length L' of the circular guide section 7 have to be carefully chosen. Experience shows that it becomes necessary to reduce these three dimensions as compared with those of standard pill-box windows.

Thus, the diameter D' is chosen to be between the sizes of the large side and the small side of the rectangular waveguide 5. Consequently, self-inductance shutters 8 are created at the rectangular guide in order to obtain a matching of the window with the center frequency of the working band of the rectangular waveguide 5.

The thickness e' of the strip 6 is chosen to be as small as possible, but sufficient to withstand the mechanical and electrical stresses to which it is subjected.

A half-wave matching transformer 10 is added. This transformer 10 is formed by two elements of the same length, placed on either side of the circular waveguide section 7, within the rectangular waveguide 5, so that they overlap at least one of its large sides. This transformer enables sufficient matching to be achieved throughout the working frequency band of the rectangular waveguide 5.

With this window, we obtain an effective bandwidth corresponding to about 40% of the center frequency.

However, this window is more complicated to make than the pill-box window. The diameter of the circular waveguide 7 is between the sizes of the large side and the small side of the rectangular waveguide 5. Consequently, additional pieces have to be used to provide for impervious sealing between the interior and the exterior of the guides, these pieces being placed at the junction between the rectangular guide 5 and the two ends of the circular guide section 7. Besides, the fact that the length of the circular guide is small in relation to its diameter does not favor its flexibility which is necessary to allow for differences, in expansion, between the ceramic and the guide.

The window according to the invention is more solid than the standard pill-box window. It is also easier to make and works in a widened frequency band without having ghost modes.

Its bandwidth performance characteristics are lose to those of the window described in the French patent No. 2 558 306, but it will be easier to make. Since its dimensions are greater than those of the window described in the patent No. FR 2 558 306, it can work at a higher peak power value. Furthermore, since the length of the circular guide has been increased with respect to that of the circular guide of the window of the patent No. FR 2 558 306, the flexibility of the guide is improved.

SUMMARY OF THE INVENTION

The invention proposes a microwave window comprising:

a circular strip made of dielectric material, mounted in a circular waveguide section having substantially the same diameter as the strip, the circular waveguide section being connected at its ends to a rectangular waveguide containing a matching transformer, wherein:

the diameter of the circular waveguide is smaller than the diagonal of the rectangle;

at each end of the circular waveguide section, a wall provides a junction, that is imperviously sealed, with respect to the exterior, between the rectangular waveguide and the circular waveguide section, each wall being provided with an aperture included in a portion of cross-section common to the rectangular waveguide and the circular waveguide section, the area of the aperture being smaller than the area of the portion of cross-section.

Each wall is transverse to the circular waveguide section.

The apertures are identical and preferably have an oblong shape. The large side of each aperture is parallel to the large sides of the rectangular waveguide.

When the apertures are substantially rectangular, the matching transformer may be formed by the extension of a large side of each aperture on the corresponding side of the rectangular waveguide.

BRIEF DESCRIPTION OF THE DRAWINGS

Other characteristics and advantages of the present invention will appear from the following description, made with reference to the appended drawings, of which:

FIGS. *1a, 1b,* already described, respectively show a view in longitudinal section and a view in cross-section, along the axis AA' of FIG. *1a,* of a standard pill-box window;

Figure 3A:
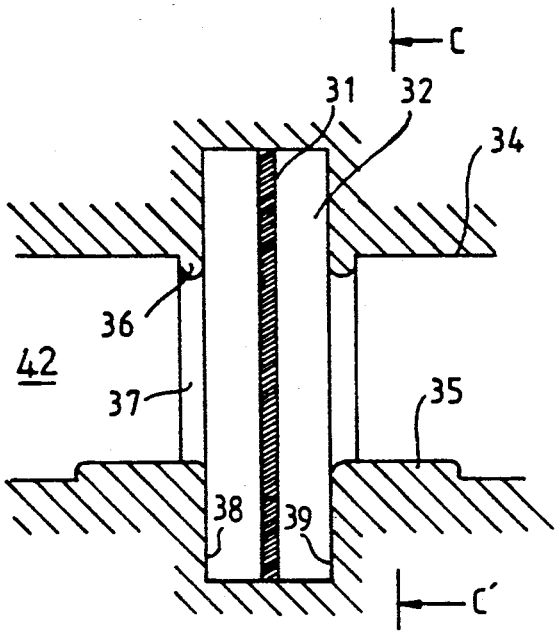

FIGS. *2a, 2b,* already described, are respectively a view in longitudinal section and a view in cross-section, along the axis BB' of FIG. *2a,* of a window described in the patent No. FR 2 558 306;

FIGS. *3a, 3b, 3c,* already described, are respectively a view in longitudinal section, along the small side of a rectangular guide, a cross-section view along the axis CC' of FIG. *3a,* and a view in longitudinal section, along the large side of the guide, of a window according to the invention;

FIG. 4 shows a schematic sectional view, along the small side of the guide, of an embodiment of a window according to the invention.

In the figures, the same references are repeated for the same elements.

DETAILED DESCRIPTION OF THE INVENTION

The window shown in FIGS. *3a, 3b, 3c* comprises a thin strip made of a non-porous dielectric material such as alumina for example. This strip 31 is circular, and it has a diameter D1 and a thickness el. It is mounted, in an imperviously sealed way, in a circular waveguide section 32 having substantially the same diameter The circular waveguide section 32 has a length L1. The two ends 38, 39 of this circular waveguide section 32 are connected to a waveguide 34 that transmits microwaves in a working frequency band. The microwaves penetrate the window by its first end 38 and come out of it by its second end 39. In the figure, the waveguide 34 is a rectangular waveguide, and the diameter of the circular waveguide 32 is smaller than the diagonal of the rectangle.

The window according to the invention, just like the window described in the U.S. Pat. No. FR 2 558 306, should be capable of working in a wide frequency band with good matching and without ghost modes.

To this end, a wall 36, provided with an aperture 37, is placed at each junction between the waveguide 34 and the circular waveguide section 32. Each wall 36 provides a junction, imperviously sealed with respect to the exterior, between the waveguide 34 and the circular waveguide section 32. Each wall 36 extends in a plane transversval to the circular waveguide section 32.

The walls 36 are located at each of the ends 38, 39 of the circular guide section 32. Each wall 36 closes a section demarcated by the joining between the cross-section of the circular waveguide section 32 and the cross-section of the waveguide 34.

At the junction between the waveguide 34 and the circular waveguide section 32, it is possible to define a portion 42 of cross-section common to the two guides 32, 34.

Each aperture 37 is contained in this cross-section portion 42. The area of each aperture is smaller than that of the cross-section portion 42.

The apertures 37 will preferably be identical and they will be located in the central part of each wall 36.

Each aperture 37 will preferably have an oblong shape. Its large side will be parallel to the large side of the waveguide 34.

Each wall 36, provided with its aperture 37, brings inductive and capacitive corrections to the waveguide 34.

The inductive corrections are given by wall portions 40, between each small side of the waveguide 34 and the edge of the aperture 37 closest to this small side.

The capacitive corrections are given by wall portions 41, between each large side of the waveguide 34 and the edge of the aperture. 37 closest to this large side.

These corrections are designed to match the window to the transmission mode used in the waveguide 34.

Experience shows that it is possible to increase and even to double the length L1 of the circular guide section 32 with respect to the length of the guide of the window described in the patent No. FR 2 558 306. It is also possible to increase the thickness el of the strip 31.

Then, a half-wave matching transformer 35 is positioned within the waveguide 34, on either side of the circular waveguide section 32. The wavelength considered corresponds to the center frequency of the working band of the waveguide 34.

Figure 3B:
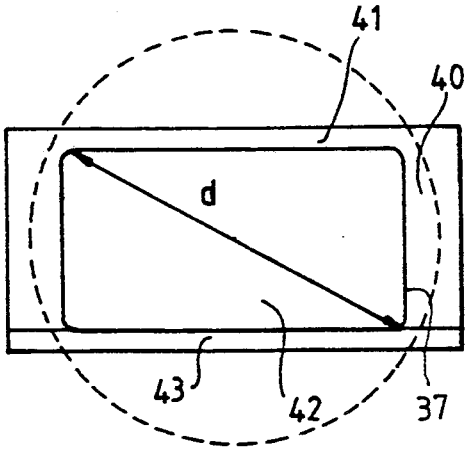
Figure 3C:
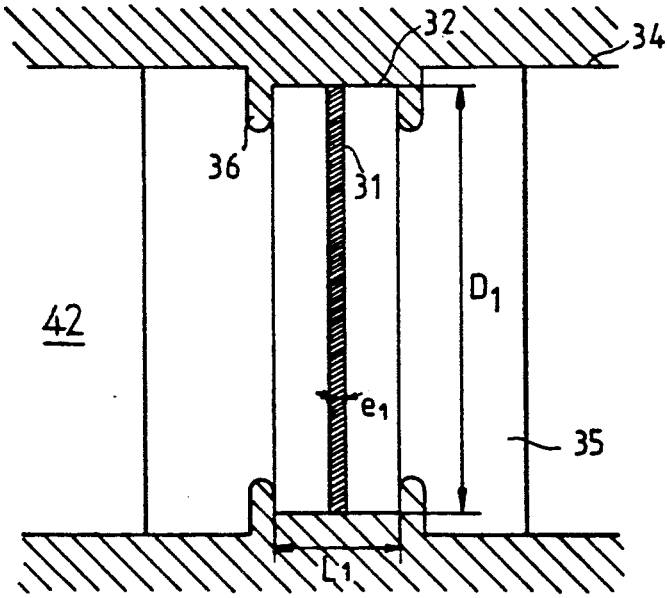

In FIGS. 3*a*, 3*b*, 3*c*, it can be seen that each wall 36 has a single partition which blocks, at the same time, an end of the circular guide section 32 and the cross-section of the waveguide 34. The wall 36 could have included a set of elements, for example a partition provided with an aperture blocking the end of the circular waveguide section 32 and clamps with a shape suited to blocking the parts of the cross-section of the waveguide 34 reaching the exterior of the circular waveguide section 32.

The apertures 37 are substantially rectangular and their large sides 43 are parallel to the large sides of the waveguide 34.

The diagonal d of each aperture 37 is then smaller than the diameter D1 of the circular waveguide section 32. The portion 42 of cross-section is included between the two large sides of the waveguide 34 and two arcs of , circles of the circular waveguide section 32.

It would have also been possible to envisage a case where the apertures 3 are rectangular with rounded corners, where they have the shape of a rectangle with a semi-circle joining each of its small sides, this semi-circle having a diameter equal to the small side. Other shapes are also possible.

In FIGS. 3*a*, 3*b*, it can also be seen that the half-wave matching transformer 35 is formed by the extension of one of the large sides 43 of each aperture 37, in the waveguide 34, on either side of the circular waveguide section 32.

This extension is done on one and the same large side of the waveguide 34, on one and the same length. It could be distributed over both large sides.

The transformer 35 extends into the interior of the waveguide, 34, all along the large side of the waveguide. FIG. 3*c* shows this. The height of the obtain the matching of the window with a relative working band of 30% with respect to the center frequency in the waveguide 34.

Tests have shown that by making a window according to the invention work in S-band, and by interposing it in an RG48U type of waveguide, very satisfactory band performance values are obtained. The diameter D1 and the thickness el of the strip are:

D1=66 mm e1=2.1 mm

The working bandwidth of the window is 30% with respect to the working center frequency in the RG48U type guide.

The mechanical strength of the dielectric strip is proportional to a coefficient K=(R/e)2, R being the radius of the strip and e being its thickness.

With the window according to the invention, as tested, a coefficient K=247 is obtained.

A standard pill-box window tested under the same conditions gives the following results:

D=85 mm, e=3 mm, and the coefficient K is then K=201.

Its working bandwidth is then 12% with respect to the working center frequency in the RG48U type guide.

A window such as the one described in the patent No. FR 2 558 306, tested under the same conditions, gives the following results:

D'=55 mm e'=1.8 mm

K=233 its working bandwidth is 40% with respect to the working center frequency in the RG48U type guide.

The window according to the invention, because of apertures 37 which are smaller than the sections of the waveguide 34 and of the circular waveguide 32, makes it possible to work in a wider band than with the pill-box window. It also has improved mechanical behavior while, at the same time, preserving the extremely simple technology of the pill-box window. Moreover, its dimensions are reduced.

Referring to FIG. 4, we shall now describe a practical method of making a window according to the invention.

The method starts with the brazing of a strip 31, made of a dielectric material, such as ceramic, into a circular waveguide section. The walls 36, which may be formed by metal plates, made of copper for example, are attached by brazing to the two ends 38, 39 of the circular waveguide section. Their shape is suited to blocking, at the same time, the cross-section of the circular guide section 32 and the cross-section of the waveguide 34. The waveguide 34 is fixed by brazing to each wall 36, on either side of the circular waveguide section 32. Each wall 36 has an aperture 37 in its central part.

Two fastening clamps 50 may be used to provide for an imperviously sealed connection between the waveguide 34 and the circular waveguide section 32.

The transformer 35 may be formed by two identical metal plates, made of copper for example. Each plate is, for example, brazed flat into the interior of the waveguide 34, on one of its large sides and on the wall 36.

The present invention is not restricted to the examples described. There may be other variants without going beyond the scope of the invention.

What is claimed is:

1. A microwave window comprising:

a flat circular disc made of dielectric material, mounted in a circular waveguide section having substantially the same diameter as the flat disc, the flat disc being thinner than the circular waveguide section, and the circular waveguide section being connected at each of its ends to a rectangular waveguide containing a matching transformer, wherein:

the diameter of the circular waveguide is smaller than the diagonal of the rectangular cross-section of the rectangular waveguide;

at each end of the circular waveguide section, walls provide that are imperviously sealed with respect to regions outside the waveguide, said walls being between the rectangular waveguides and the circular waveguide section, each wall being provided with an aperture in a region between the circular waveguide section and a rectangular waveguide, the area of the aperture being smaller than the area of the cross-section of the rectangular waveguide.

2. A microwave window according to claim 1, wherein each wall is transverse to the circular waveguide section.

3. A microwave window according to either of the claims 1 or 2, wherein the apertures are identical.

4. A microwave window according to claim 1, wherein each aperture is oblong.

5. A microwave window according to claim 4, wherein each large side of the aperture is parallel to the large sides of the adjacent rectangular waveguide.

6. A microwave window according to either of claims 4 or 5, wherein each aperture is substantially rectangular.

7. A microwave window according to claim 6, wherein a matching transformer is formed by the extension of a large side of each aperture on the corresponding side of the rectangular waveguide.

8. A microwave window according to claim 7, wherein each large side of the aperture extends an equal length away from the window, thereby forming half-wave transformers in the rectangular waveguide.

* * * * *